United States Patent [19]

Tani

[11] 4,056,911

[45] Nov. 8, 1977

[54] STEEL BAR FOR CONCRETE REINFORCEMENT HAVING A NON-CIRCULAR CROSS-SECTION

[75] Inventor: Yoshio Tani, Kobe, Japan

[73] Assignee: Kobe Steel, Ltd., Kobe, Japan

[21] Appl. No.: 699,224

[22] Filed: June 23, 1976

[30] Foreign Application Priority Data

June 23, 1975 Japan ..... 50-77724

[51] Int. Cl.[2] ..... E04C 5/03

[52] U.S. Cl. ..... 52/738; 52/739; 52/740

[58] Field of Search ..... 52/737–740

[56] References Cited

U.S. PATENT DOCUMENTS 3,292,337 12/1966 Finsterwalder ..... 52/738

FOREIGN PATENT DOCUMENTS 550,428 10/1956 Italy ..... 52/737

169,228 6/1965 U.S.S.R. ..... 52/737

*Primary Examiner*—James L. Ridgill, Jr.

*Attorney, Agent, or Firm*—Oblon, Fisher, Spivak, McClelland & Maier

[57] ABSTRACT

A steel bar for concrete reinforcement has a non-circular cross-section which comprises two sets of transverse ribs disposed respectively at diametrically opposite surface portions of the core of the steel bar, each set consisting of a number of transverse ribs of a lug-forming projection type disposed at a position corresponding to every pre-selected pitch in the longitudinal direction of the steel bar and extending therefrom in planes substantially transverse to the core; and a pair of longitudinal ribs disposed on the diametrically opposite surface portions of the core at the intermediate positions between the sets of transverse ribs and extending from the core linearly in the longitudinal direction thereof; the outer portion of each of the longitudinal ribs being as remote as or less remote from the axis of the steel bar as compared with the distance between the axis and the surface of the portion on the outer circumferential plane of the core located at the remotest position from the axis; the major central portion of the outer surface of each of the transverse ribs being placed on the lateral surface of a hypothetical column of a larger diameter than the hypothetical column having the axis of the steel bar as its center and the lateral surface of which tangentially contacts the outer surface of the core; and the outer surface of the wing portion of each of the transverse ribs being disposed in such a manner that the distance from the axis is reduced progressively towards the outer portion of the longitudinal ribs; whereby the transverse ribs can mate with a female helical thread of a corresponding pitch in a nut, coupler or anchor sleeve.

9 Claims, 17 Drawing Figures

STEEL BAR FOR CONCRETE REINFORCEMENT HAVING A NON-CIRCULAR CROSS-SECTION

BACKGROUND OF THE INVENTION

1. Field of the Invention

This invention relates to a steel bar or rod having a non-circular cross section for use in concrete reinforcement.

2. Description of the Prior Art

Steel bars having a non-circular cross section have been widely used in lieu of round bars as reinforcing bars for reinforcing concrete in the field of civil engineering and construction. While some of these steel bars have only either transverse ribs of varying shapes disposed around the outer circumference thereof so as to extend in the circumferential direction, or longitudinal ribs of varying shapes extending in the longitudinal direction, others have both transverse and longitudinal ribs as disclosed, for example, in U.S. Pat. Nos. 2,374,827 and 2,377,980.

In conjunction with the progress made in devising techniques for saving labor in the construction and development of light-weight construction materials, prefabricated reinforcing bar assemblies of a non-circular cross section have been produced on a massive scale and have gained wide application in recent years. The mass-production of the prefabricated reinforcing steel bar assemblies has succeeded in the drastic reduction in the time required for fabricating a concrete construction, and the improvement in the working efficiency, as well as the standardization of the reinforcing steel bars.

The only one principal problem left unsolved with the reinforcing steel bars of this type is the coupling or joint as a connecting structure between two similar reinforcing steel bars. The ideal coupler would be one that can connect similar reinforcing steel bars easily and rapidly, compensate for a considerable assembly error as well as a dimensional error, and yet ensure an accurate and reliable connection. These requirements are of utmost importance especially for the reinforcing steel bars having a non-circular cross section. Though there have to this date been proposed various coupling structures such as a thread-coupling system, a pressure-sleeve system and the like, all of them are directed to be adapted to commercially available reinforcing steel bars of a non-circular cross section and hence, are not perfectly satisfactory.

To cope with the above mentioned problem, a specific coupling structure has recently come to be provided for a reinforcing steel bar having a non-circular cross section per se so as to thereby simplify the coupler means, and tools, as well as the operations involved for accomplishing the coupling. As a typical example of the reinforcing bars of this type, mention can be made of a so-called threaded reinforcing steel bar wherein a number of lug-forming independent transverse ribs are disposed around the outer circumference of the bar in such a manner that groups of these transverse ribs can mate with a female helical thread.

As shown in FIGS. 1 and 2 more specifically, a number of transverse ribs 2 are disposed on the outer circumference of the bar 1 at every pre-selected pitch in the longitudinal direction thereof. Each of these transverse ribs 2 has a lug-forming shape extending from the core of the bar 1 and is assorted into two groups of ribs *2a, 2b* which are disposed on the diametrically opposite surface portions of the core of the bar 1. The groups of the ribs *2a, 2b* are disposed in the arrangement such that lugs of the ribs can mate with female threads sequentially. The reinforcing steel bars of this construction shown in FIGS. 1 and 2 are disclosed respectively in U.S. Pat. Nos. 3,782,839 and 3,561,185.

Because of the mating engagement with female threads, this type of reinforcing steel bar can be connected easily with each other by the use of a coupler-type sleeve and have an excellent threaded fixation and exhibit a reliable coupling action. In addition, tenacity of the reinforcing steel bar itself is satisfactorily high.

As shown in the enlarged sectional view of FIG. 3, the cross-sectional shape of the core of the conventional threaded reinforcing steel bar 1 is substantially round except for the groups of the transverse ribs 2. As shown in this Figures, the two groups of the transverse ribs 2 are disposed at opposed positions on the outer circumferential plane of the core of the steel bar. In this FIG. 3, the upper half of the group of ribs is shown to have a top portion which is concentric with the core while the lower half thereof is shown possessed of an oval bottom portion which has a roundness unlike the roundness of the core.

In this instance, the transverse ribs having the top portion are disposed so as to define an independent lug-form extending in the circumferential direction of the steel bar. Because of the coupling by means of the mating engagement with the female threads, however, no longitudinal rib is formed on the outer circumferential plane of the core so as to extend linearly in the longitudinal direction of the steel bar 1. In FIG. 3, the symbol 0 stands for the longitudinal axis of the core of the steel bar 1.

The reinforcing bar of the above-described type is generally produced by a hot-rolling process in order to satisfy the requirement of standardized mass-production. According to this process, a steel bar material is first hot pressed so as to possess an oval or a flat hexagonal cross section and is then passed through a pair of finishing rolls having a caliber as illustrated in FIGS. 4 and 5, whereby the steel bar is roll-shaped so as to have a cross section as shown in FIG. 3. The portion 3 of the caliber indicated by the full line in FIG. 4 is provided so as to shape the cubic outer circumferential surface of the steel bar into a circular form while the portion 4 thereof indicated by the dotted line is provided so as to shape the transverse ribs 2 having a top portion which is concentric with the core shown in FIG. 3.

Likewise the portion *4a* indicated by the dotted line in FIG. 5 is provided so as to shape the transverse ribs 2 having an oval bottom portion shown in FIG. 3.

FIG. 6 illustrates the relation between the steel bar material *1a* and a pair of finishing rolls 5, 5. During the roll-shaping operation of the steel bar material using the pair of finishing rolls 5, 5 having the caliber shown in FIGS. 4 and 5, the material *1a* having an oval or a flat hexagonal cross section is compressed from the top and bottom whereby a swelling section is formed in the transverse direction. Using this swelling section, the cross section of the core of the steel bar 1 is shaped into a roundness simultaneously with the formation of the transverse ribs 2. The reference numeral 6 represents a gap between the pair of rolls 5, 5.

For this reason, it is necessary to strictly control the cross-sectional area of the steel bar, the rolling shape thereof, the gap between the rolls, and the rolling speed. Even if all these conditions are perfectly satisfied, the effective length of the transverse rib 2 (in the circumferential direction of the steel bar 1) remains only in the range of about $\frac{1}{3}$ to $\frac{1}{2}$ of the circumferential length of the steel bar 1 in view of the essential conditions for the reinforcing steel bars of this type such as the bonding power of the concrete and the fixation of the threads in the coupling sections.

In other words, the effective length of the transverse rib 2 is considerably shorter when contrasted with that of the heretofore known reinforcing steel bars of a non-circular cross section in general. Namely, the threaded bar of the above-described type yet leaves unsolved problems with respect to the bonding power of the concrete and the stable and reliable fixation of the screw engagement.

SUMMARY OF THE INVENTION

The present invention is directed to solve the above mentioned problems with conventional steel bars for concrete reinforcement having a non-circular cross section.

The first object of the present invention is to provide a steel bar for concrete reinforcement which is capable of engaging with a female thread and which affords a perfect and ready coupling between similar bars and the bonding of concrete.

The second object of the present invention is to provide a steel bar for concrete reinforcement which exceeds by far the conventional steel bar in every respect of producibility, the bonding power of concrete, thread fixation, and the couling between similar bars.

The first embodiment to accomplish these and other objects of the present invention provides a steel bar for concrete reinforcement having a non-circular cross-section which comprises two sets of transverse ribs disposed respectively at diametrically opposite surface portions of the core of the steel bar, each set consisting of a number of transverse ribs of a lug-forming projection type disposed at a position corresponding to every pre-selected pitch in the longitudinal direction of the steel bar and extending therefrom in planes substantially transverse to the core; and a pair of longitudinal ribs disposed on the diametrically opposite surface portions of the core at the intermediate positions between said sets of transverse ribs and extending from the core linearly in the longitudinal direction thereof; the outer portion of each of said longitudinal ribs being as remote as or less remote from the axis of said bar as compared with the distance between said axis and the surface of the position on the outer circumferential plane of the core located at the remotest position from the axis, the major central portion of the outer surface of each of said transverse ribs being placed on the lateral surface of a hypothetical column of a larger diameter than the hypothetical column having the axis of the steel bar as its center and the lateral surface of which tangentially contacts the outer surface of said core; and the outer surface of the wing portion of each of said transverse ribs being disposed in such a manner that the distance from the axis is reduced progressively towards the outer portion of said longitudinal ribs; whereby said transverse ribs can mate with a female helical thread of a corresponding pitch in a nut, coupler or anchor sleeve.

The second embodiment of the present invention provides the steel bar of the type as described in the above mentioned first embodiment wherein the height of said longitudinal rib is in the range of 1.0 to 2.0 mm.

The third embodiment of the present invention provides the steel bar of the type as described in the above mentioned first embodiment wherein the height of said transverse rib is $$0.05D_N{}^{+1.3mm}_{+0.5mm}$$

that is, from $(0.05D_N + 0.5)$ mm to $(0.05D_N + 1.3)$mm whereby $D_N$ is a nominal diameter of the steel bar.

The fourth embodiment of the present invention provides the steel bar of the type as described in the above mentioned first embodiment wherein the pitch (P) of the transverse rib and the height (h) thereof satisfy the following relationship $$3 \leqq P/h \leqq 11.$$

The fifth embodiment of the present invention provides the steel bar of the type as described in the above mentioned first embodiment wherein the nominal diameter ($D_N$), the pitch ($p$) and height ($h$) of the transverse rib satisfy the following relationship:

$$1.4\sqrt{h/D_N} \leqq P/D_N \leqq 2.5\sqrt{h/D_N}.$$

The sixth embodiment of the present invention provides the steel bar of the type as described in the above mentioned first embodiment wherein the width ($w$) at the root of the transverse rib is in the range of $0.081D_N$ to $0.30D_N$, preferably from $0.17D_N$ to $0.30D_N$, whereby $D_N$ is the nominal diameter of the steel bar.

The seventh embodiment of the present invention provides the steel bar of the type as described in the above mentioned first embodiment wherein an angle defined between the plane of the thread of the transverse rib and the top portion thereof (flank angle) is in the range of 23° to 60°.

The eighth embodiment of the present invention provides the steel bar of the type as described in the above mentioned first embodiment wherein the width of the longitudinal rib is in the range of L/36 to L/12 wherein L is the nominal perimeter of the steel bar.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein:

FIG. 16 (*b*) is a sectional view of the steel bar of this invention taken along the line a—a of FIG. 16 (*a*).

DETAILED DESCRIPTION OF THE PREFERRED EMBODIMENTS

The present invention will be made more apparent with reference to the accompanying drawings.

Figure 7:
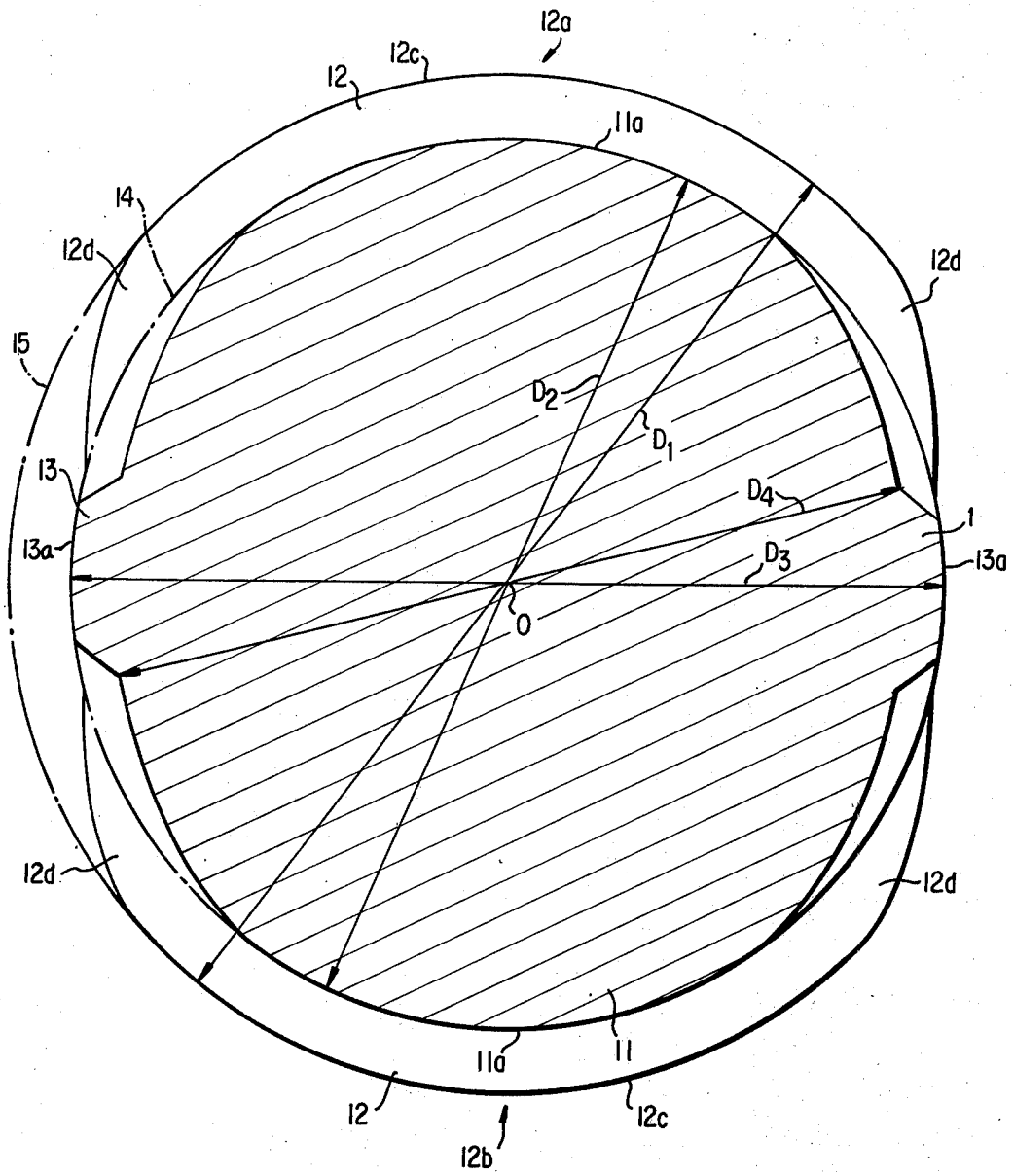
FIG. 7 is a sectional view of an embodiment of the steel bar in accordance with the present invention.

FIG. 7 is a sectional view showing a section of the steel bar formed in accordance with the present invention, and the core 11 of the steel bar is shown provided with transverse ribs 12, 12 and longitudinal ribs 13, 13.

More specifically, two sets of transverse ribs **12*a*, 12*b* are disposed integrally on the diametrically opposite surface portions of the core 11, each set consisting of a number of transverse ribs of a lug-forming projection type disposed at every pre-selected pitch in the longitudinal direction of the steel bar so as to extend in the outer circumferential plane of the core 11. A pair of longitudinal ribs 13, 13 are disposed likewise on the diametrically opposite surface portions of the core 11 at intermediate positions between the two sets of transverse ribs 12*a*, 12*b*** so as to extend linearly in the longitudinal direction of the steel bar.

Each outer portion **13*a*, 13*a* of the longitudinal ribs 13, 13 as well as the surface of the portion 11*a*, 11*a* on the outer circumferential plane of the core 11 of the steel bar which is located at the remotest position from the axis 0 of the bar is positioned upon a locus 14 having the axis 0** as its center.

Figure 3:
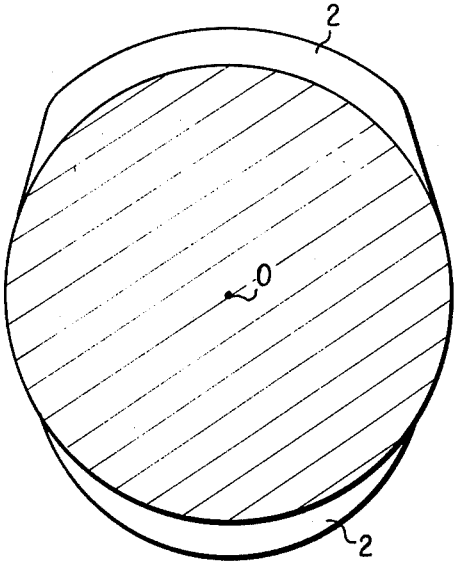
FIG.3 PRIOR ART
FIG. 3 is a sectional view of the conventional threaded steel bar for concrete reinforcement shown in FIGS. 1 and 2.
Figure 4:
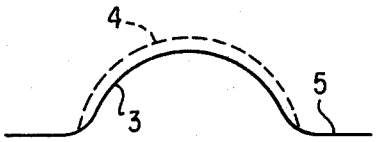
PRIOR ART FIG.4
FIG. 4 is a schematic view of a roll caliber for roll-shaping the conventional steel bar having a non-circular cross-section for concrete reinforcement.
Figure 5:
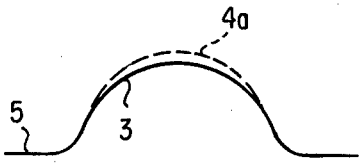
PRIOR ART FIG.5
FIG. 5 is also a schematic view of a roll caliber for roll-shaping the conventional steel bar having a non-circular cross section for concrete reinforcement.
Figure 6:
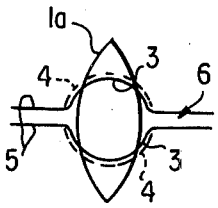
PRIOR ART FIG.6
FIG. 6 is a schematic view illustrating the mode of roll-shaping the conventional steel bar having a non-circular cross section.

On the other hand, each major central portion **12*c* of the outer surface of each transverse rib 12 is placed on a locus 15 having a diameter larger than that of the above mentioned locus 14. The outer surface of each wing portion 12d, 12d of the transverse ribs 12, 12 is disposed in such a manner that the distance from the axis 0 is progressively reduced towards the portions 13a, 13a of the longitudinal ribs 13, 13. Each of the dimensions $D_1$ through $D_4$ illustrated in FIG. 3 is arranged so as to satisfy the relation $D_1 > D_2 \geqq D_3 > D_4$. Of these $D_1$ represents the diameter of the locus 15; and $D_3$ represents the diameter between each outer portion 13a, 13a of the longitudinal ribs 13, 13 which may be within a range which extends between being either equal to, or smaller than, the diameter $D_2$ of the locus 14.**

Figure 1:
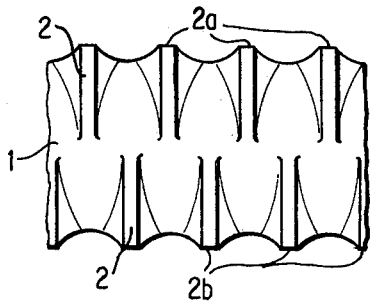
PRIOR ART FIG.1
FIG. 1 is a side view of the conventional threaded steel bar for concrete reinforcement.
Figure 2:
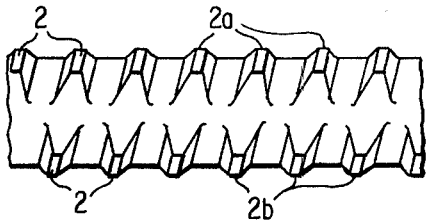
PRIOR ART FIG.2
FIG. 2 is a side view of the conventional threaded steel bar for concrete reinforcement.

Though the side view of the steel bar of the invention is deleted, the two sets of transverse ribs **12*a*, 12*b* of the present steel bar are disposed in such an arrangement which permits the same to engage with female threads in the same way as in the conventional threaded steel bar illustrated in FIGS. 1 and 2.**

The advantage of the threaded steel bar having the specific shapes of the transverse and longitudinal ribs 12, 13 in accordance with the present invention will now be explained more specifically with reference to FIG. 8.

Figure 8:
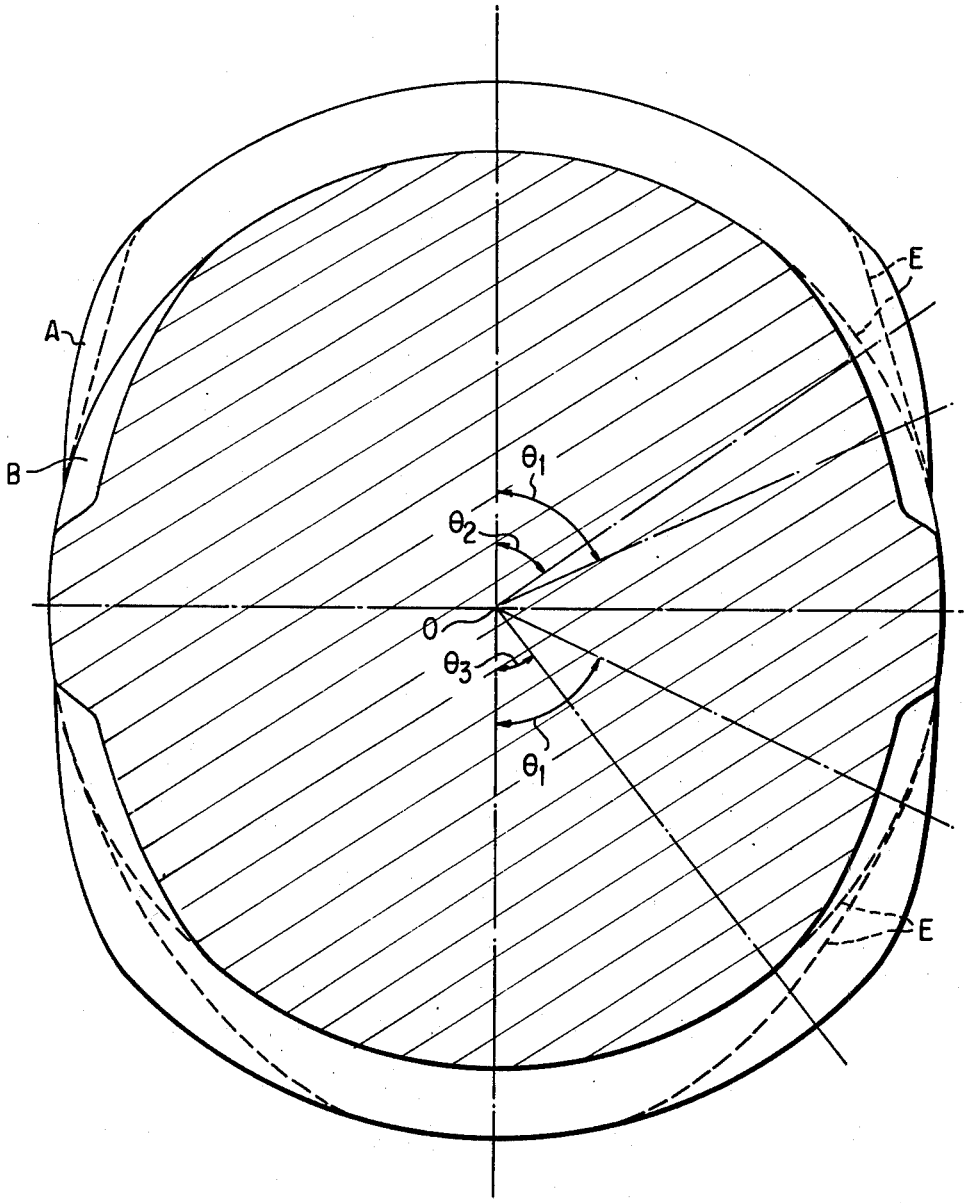
FIG. 8 is a schematic sectional view illustrating the principal section of the steel bar of this invention in comparison with that of the conventional steel bar.

In FIG. 8, the full lines indicate the contours of the transverse and longitudinal ribs as can be appreciated from FIG. 7 while the broken lines indicate the contour of the transverse ribs in the conventional threaded steel bar (see FIG. 3). The upper half from the axis of this FIG. 8 illustrates the case where the half of the top portion of the transverse rib is positioned on the circumference having the axis as its center while the lower half thereof illustrates the case where the top portion of the transverse rib is positioned on the periphery of an oval shape which corresponds to the transverse ribs 2, 2 shown in FIG. 3.

When only the transverse ribs 2, 2 are roll-reduced by a pair of the finishing rolls 5, 5 and then hot-rolled by the conventional process, the metal fills up the portion encircled by the broken lines (E) and thus forms the transverse ribs 2, 2 simultaneously with the formation of the substantially round core of the steel bar.

In comparison with the conventional process, in order to roll-shape the longitudinal ribs 13, 13 at the positions corresponding to the gap 6 between the pair of finishing rolls 5, 5 as in the present invention, the ribs 13, 13 can not be formed unless the portion B shown in FIG. 8 is rollreduced strongly. When the portion B is strongly roll-reduced, a larger amount of the metal is charged into the portion A in the reactive manner through the caliber whereby the portion A is rolled so as to extend outwardly.

When contrasted with the conventional threaded steel bar which does not have any longitudinal rib, therefore, the effective length of the lug 12, that is to say, the length of the thread at an effective diameter ($\theta_1 > \theta_2 > \theta_3$ relative to 0 in FIG. 3), can be made longer, and the portions A and B act as an increased area in order to bear the pressure. Above all, both wing portions **12*d*, 12*d* of each transverse rib 12** are allowed to effectively extend transversely. Accordingly, the effective length of the thread is never in such a short range such as $\frac{1}{3}$ and $\frac{1}{2}$ of the perimeter of the steel bar as in the conventional threaded reinforcing bar, but can be extended to more than $\frac{1}{2}$ of the same. For this reason, the coupling action as well as the fixation of the thread can be substantially improved.

By virture of the presence of the portions A and B as the increased pressure-bearing areas, it is further noted that the bonding power of concrete can also be improved to a marked extent.

Figure 9:
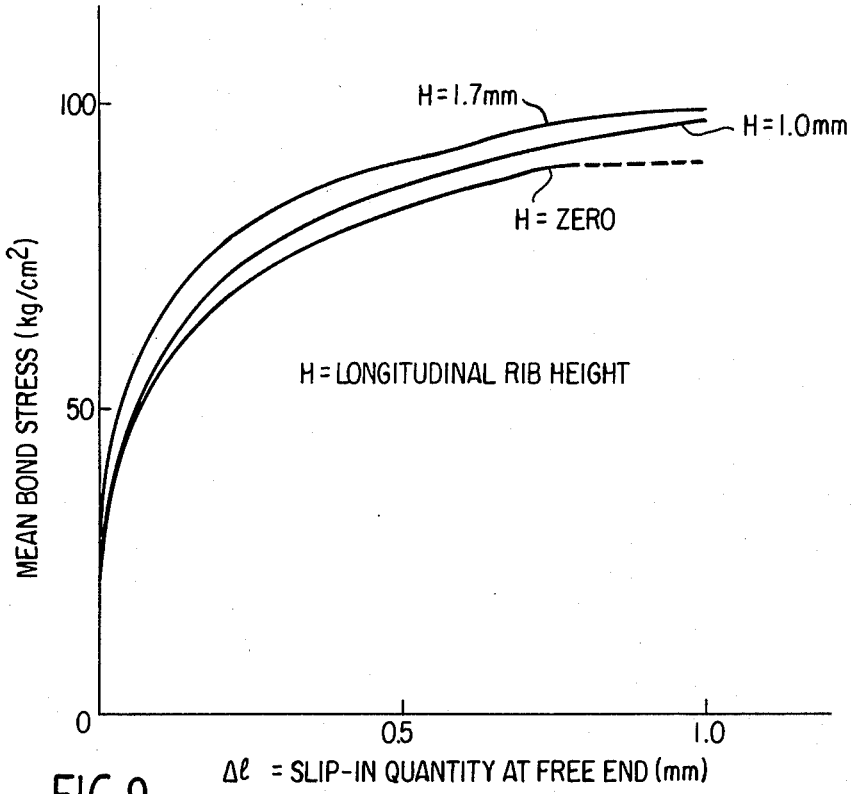
FIG. 9 is a chart illustrating the results of comparative experiments of the bondability of concrete between the steel bar of this invention and a conventional steel bar.
Figure 10:
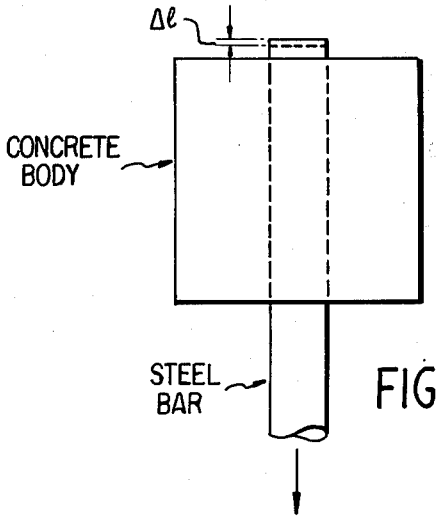
FIG. 10 is a schematic view illustrating the mode of a pull-out test for the measurement of the bondability of concrete.

FIG. 9 illustrates the results of experiments to evidence the above mentioned fact wherein sample steel bars tentatively rolled, each having a longitudinal rib of a height of 0mm, 1.0mm or 1.7mm and a nominal diameter of 25.4mm, are embedded into the central portion of a cubic concrete body having a side of 150mm as shown in FIG. 10. After the concrete is aged sufficiently (to set) and the compression force of the concrete reaches 270 Kg/cm$^2$, tension is applied to the steel bar. The experiments are directed to determine the relation between the mean bond stress (a value obtained by dividing this tension by the surface area of the embedded section of the steel bar into the concrete) and the sank-in quantity of the steel bar into the concrete, that is, $\Delta l$ (which is the slip-in quantity at the free end). This experiment is generally referred to as the "pull-out test".

Incidentally, the steel bar having the longitudinal rib of a height of 0mm corresponds to the conventional threaded steel bar such as disclosed in the aforementioned U.S. Pat. Nos. 3,561,185 and 3,782,839.

The experiments reveal that the maximum mean bond stress are 91.3 Kg/cm², 102.5 Kg/cm² and 102.1 Kg/cm², respectively, for the height of the longitudinal rib of 0mm, 1.0mm and 1.7mm.

Accordingly, as can be seen clearly from the diagram in FIG. 9, the steel bar of the present invention provides a better bonding power of concrete than the conventional threaded steel bar when the height of the longitudinal rib exceeds 1.0mm.

However, the increase of the height of the longitudinal rib results in the increase in the value $(D_2 - D_4)$ shown in FIG. 7 and thus increases the degree of ovalness of the core 11 of the steel bar. This leads to directionality of the steel bar during the bending operation thereof and is not, therefore, desirable. For this reason, the height of the longitudinal rib should not exceed 2.0mm, and is preferably in the range of 1.0mm to 2.0mm.

Figure 12:
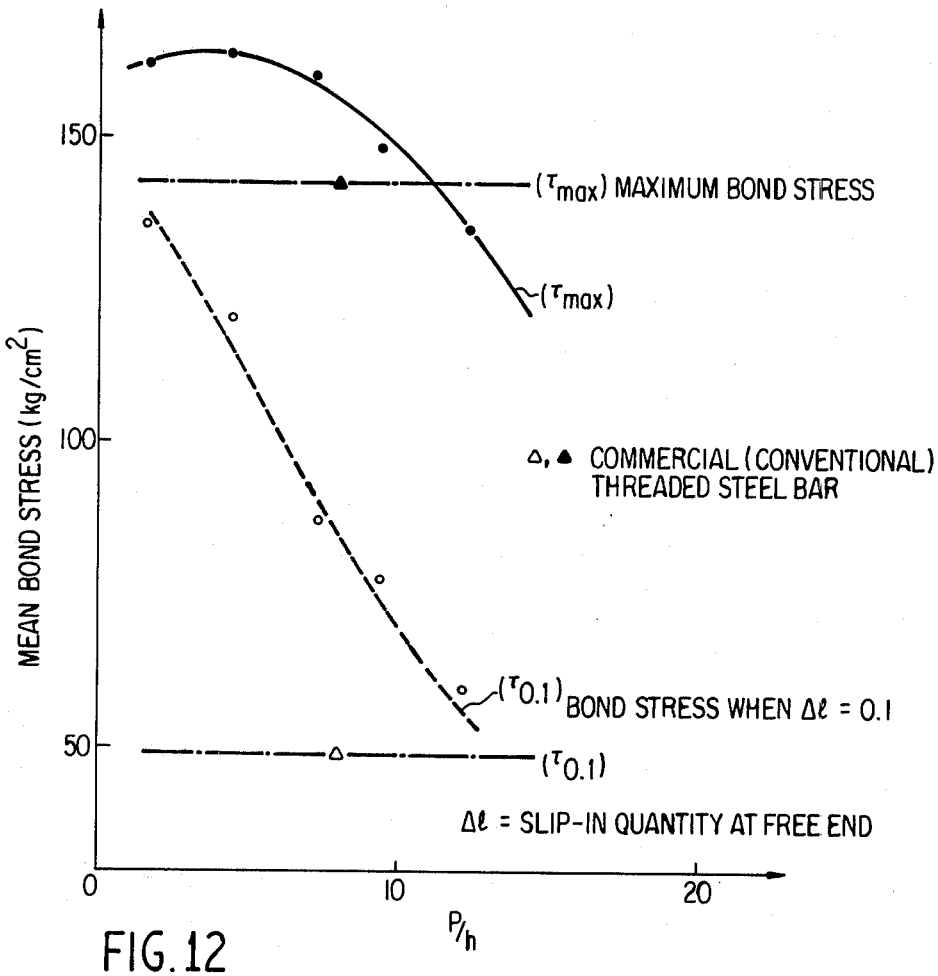
FIG. 12 is a chart illustrating the correlation between the disposition and shape of the transverse rib of the steel bar and the bondability of concrete thereof.

FIG. 12 illustrates the results of the pull-out tests wherein the pitch ($p$) as well as the height ($h$) of the transverse rib of a sample steel bar having a nominal diameter of 25.4mm are varied. As can be seen, when the slip-in quantity of the free end $\Delta l$ is 0.1 mm, in order for the degree of the bond stress $\tau_{0.1}$ to be larger than that of the commercially available threaded steel bar, it is necessary that the $p/h$ ratio be equal to, or less than, 13 that is, $p/h \leqq 13$.

Figure 11:
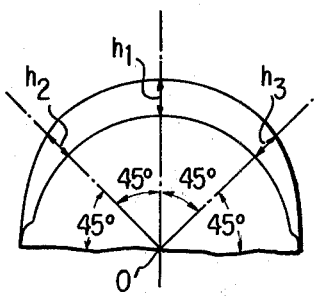
FIG. 11 is a schematic view illustrating the definition of the height of the transverse rib of the steel bar.

In this instance, the height $h$ is an arithmetical mean value of the height $h_1$ of the transverse rib at the central position and those heights ($h_2$ and $h_3$) at the positions displaced 45° respectively from a line connecting the position of $h_1$ and the axis 0 of the steel bar as shown in FIG. 11 and given by the equation:

$$h = \frac{1}{3} \cdot (h_1 + h_2 + h_3)$$

In order that the bond stress $\tau_{max}$, when the slip-in quantity at the free end becomes a maximum, exceeds the mean bond stress of the commerically available steel bar having a non-circular cross section, the $p/h$ ratio should be equal to, or less than 11 that is, $p/h \leqq 11$. When the $p/h$ ratio is smaller than 3, then $\tau_{max}$ tends to decrease along with the decrease in the $p/h$ ratio. It is therefore desirable that the p/h satisfies the following relation:

$$3 \leqq p/h \leqq 11.$$

The height of the transverse rib is preferably higher in order to enhance the bondability of the concrete as well as thread coupling. On the contrary, the height of the same is preferably lower for the handling of the steel bar so that the screw thread is not deformed. From the aspect of the rolling technique, too, the height of the transverse rib is preferably low because, if not, a uniform angle for the thread surface can not be guaranteed. Hence, the height (h) of the transverse rib should be in the following range:

$$h = 0.05D_N \begin{smallmatrix} +1.3mm \\ +0.5mm \end{smallmatrix}$$

that is $$(0.05D_N + 0.5)\text{mm} \leqq h \leqq (0.05D_N + 1.3)\text{mm}.$$

The aforementioned restriction of the $p/h$ ratio using FIG. 12 is based on the concept of the conventional designing process that "the slipin quantity at the free end be small with respect to a given load". Recently, the concept of the designing process of the ultimate strength has come to be adapted and increased attention has been drawn to the fact that the bondability of concrete is not fractured in a brittle manner.

Figure 13:
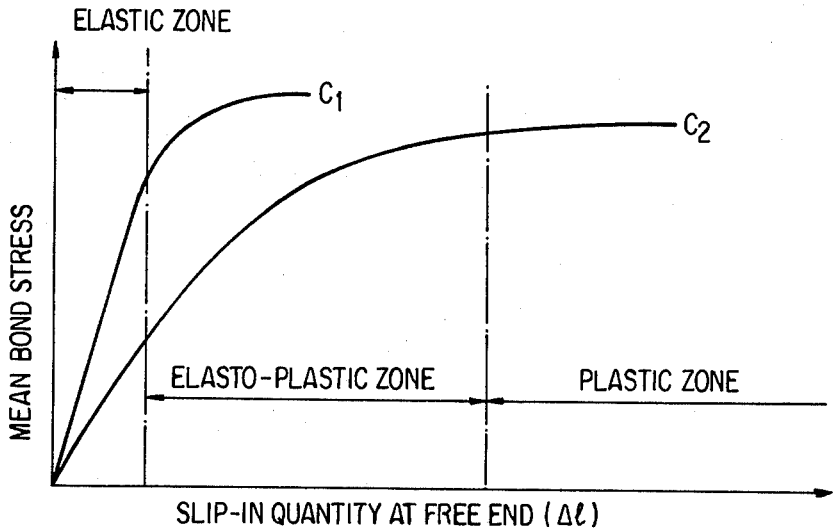
FIG. 13 is a diagram illustrating the bonding characteristics of concrete.

FIG. 13 schematically illustrates two typical concrete-bonding characteristics curves of the steel bar. The curve $C_1$ is of a brittle nature and represents the drastic fracture of the concrete between the transverse rib and the longitudinal rib of the steel bar by shearing. The fracture of concrete of this nature is referred to as the "shearing fracture". On the other hand, the curve $C_2$ is of a ductile nature and represents the gradual and partial fracture of the concrete between the transverse ribs of the steel bar, which is referred to as the "bearing fracture".

From the aspect of the designing process of the ultimate strength for a steel bar for concrete reinforcement, the most ideal bonding characteristics would be one which satisfies the following two requirements, that is,

1. it is upright in the zone of elasticity and

2. it has a large zone of elasto-plasticity.

Figure 14:
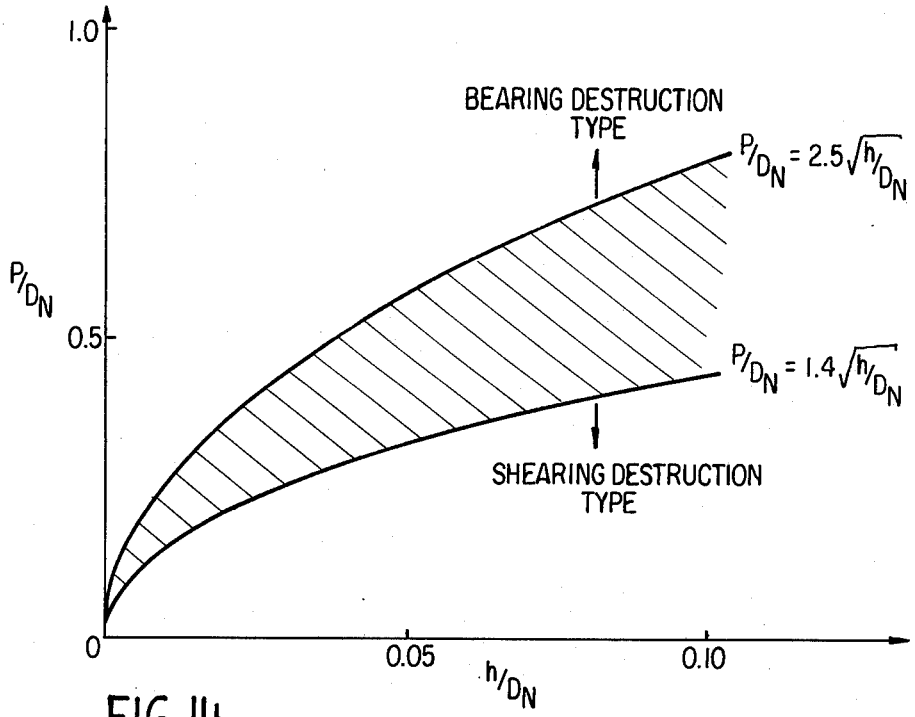
FIG. 14 is a diagram illustrating the correlation between the bondability of concrete to the steel bar, and the pitch and height of the transverse rib of the steel bar.

On the basis of this concept, the relation between the pitch ($p$) and height of the transverse rib is determined from the results of the pull-out test so as to stipulate the zone where both the shearing resistance and bearing resistance effectively act simultaneously. This zone is represented by the oblique lines in FIG. 14. When expressed by the general formula $$P/D_N = k\sqrt{h/D_N} (k = \text{constant})$$

the zone is expressed by $$1.4\sqrt{h/D_N} \leqq P/D_N \leqq 2.5\sqrt{h/D_N}.$$

Figure 15:
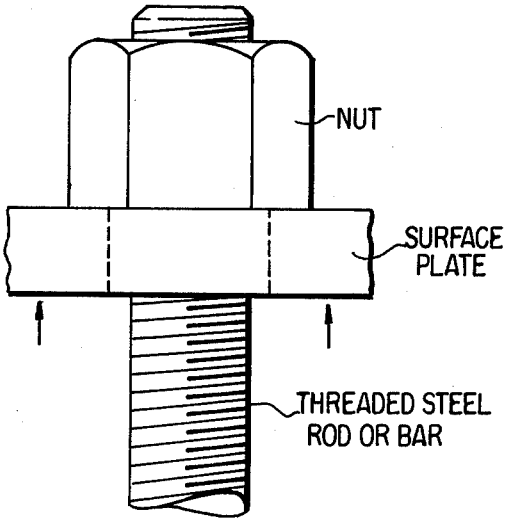
FIG. 15 is a schematic view illustrating the mode of a fracture test apparatus for the steel bar.

In the experiment wherein a threaded steel bar is secured to a stationary board by a nut and subjected to a fracture test by applying thereto a tension as shown in FIG. 15, the following relation has already been confirmed necessary between the number of screw threads ($n$), the width ($w$) at the root of the thread and the nominal diameter ($D/_N$) of the steel bar in order that the core of the steel bar be fractured without thereby causing the fracture of the thread of the steel bar or of the nut:

$$nw \geqq 1.72\ D_N.$$

However, the length of the nut can not be increased in an unlimited manner in practice because it renders serious problems in producing the nut per se as well as a coupler which usually has a length two times longer than that of the nut. In other words, various problems result, such as damage of the screw-cutting tap or bite, deterioration of the quality of the products and the like. For these reasons, the length of the nut should be kept generally to not more than $2D_N$.

In this instance, the restriction to the width ($w$) of the transverse rib is $$w = 0.081D_N \text{ to } 0.30D_N$$

since $$3 \leqq p/h \leqq 11, \text{ and}$$

$$(0.05D_N + 0.5) \leqq h \leqq (0.05D_N + 1.3).$$

However, the width ($w$) is preferably in the range of $$w = 0.17D_N \text{ to } 0.30D_N.$$

Figure 16A:
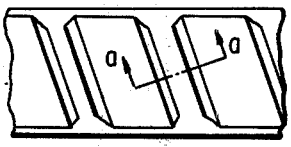
FIG. 16 (*a*) is a plan view of the steel bar of this invention.
Figure 16B:
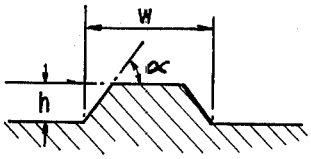

On the basis of this restriction of the width ($w$) and the aforementioned restriction of the height ($h$) of the transverse rib, the flank angle ($\alpha$) of the thread surface of the transverse rib shown in FIG. 16(*b*), which is a sectional view along the line *a*—*a* of the plan view of FIG. 16(*a*), can be restricted as follows:

$$\alpha \geqq 23°.$$

This angle ($\alpha$) may be larger than 23° theoretically, but may also be limited to the upper limit of about 60° from the viewpoint of the rolling technique, though the value naturally varies to certain extents depending upon the rolling speed and the diameter of the roll.

Next, so long as the area of the longitudinal rib of the steel bar is about half the allowable error of a nominal cross sectional area, various controlling operations for rolling can be deleted. This is proved by rolling experiences of ordinary reinforcing bars. When the height of the longitudinal rib is from 1.0 to 2.0 mm, the width thereof is preferably in the range of L/36 to L/12 (wherein L is a nominal perimeter, that is, $L = \pi D_N$, ($\pi$: circular constant).

As has hereinabove been described in detail the steel bar for concrete reinforcement constructed in accordance with the present invention not only mates with a coupler having a female thread, but also eliminates various strict controlling operations required conventionally during the hot-rolling operation by means of finishing rolls, such as the control of the cross-sectional area of the steel bar, the gap between the finishing rolls, the rolling speeds and the like because the area of the longitudinal ribs mitigates the error. Accordingly, the present invention solves the problems with the production of a conventional threaded steel bar having a noncircular cross section, improves the producibility of the steel bar and provides a bar having an improved bonding power for concrete, thread fixation, and coupling action with a coupler. Furthermore, the present invention should not be restricted to only a steel bar for concrete reinforcement, but could also be adopted to a steel bar for prestressed concrete and an anchoring bolt.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A steel bar for concrete reinforcement, having a noncircular cross section and including a core portion, and having a longitudinally extending axis, which comprises:

two sets of transverse ribs disposed respectively upon first diametrically opposite surface portions of the core of the steel bar, each set consisting of a number of transverse ribs of a lug-forming projection type disposed at a position corresponding to every preselected pitch in the longitudinal direction of the steel bar and extending therefrom in planes substantially transverse to the core;

a pair of longitudinal ribs disposed on second diametrically opposite surface portions of the core at the intermediate positions between said sets of transverse ribs and extending from the core linearly in the longitudinal direction thereof;

the outer portion of each of said longitudinal ribs being disposed upon a locus which is located a distance from the axis of said steel bar which lies in a range which extends between being equal to or less than the distance between said axis and the outer circumferential surface portions of said first diametrically opposite surface portions of the core located at the remotest position from said axis;

the major central portion of the outer surface of each of said transverse ribs being disposed upon a locus having a larger diameter than the locus having the axis of the steel bar as its center and a surface which tangentially contacts the outer surface of said core; and the outer surface of the wing portion of each of said transverse ribs being disposed in such a manner that the distance from the axis is reduced progressively towards the outer portion of said longitudinal ribs;

whereby said transverse ribs can mate with a female helical thread of a corresponding pitch in a nut, coupler or anchor sleeve.

2. The steel bar as defined in claim 1 wherein the height of each of said longitudinal ribs is from 1.0 to 2.0 mm.

3. The steel bar as defined in claim 1 wherein the height of each of said transverse ribs is from $(0.05D_N + 0.5)$ to $(0.05D_N + 1.3)$mm in which $D_N$ is a nominal diameter of said steel bar.

4. The steel bar as defined in claim 1 wherein the height ($h$) and pitch ($p$) of said transverse ribs satisfy the relation $3 \leqq p/h \leqq 11$.

5. The steel bar as defined in claim 1 wherein:

the pitch ($p$) of said transverse ribs and the nominal diameter $D_N$ of the steel bar satisfy the relation $1.4\sqrt{h/D_N} \leqq p/D_N \leqq 2.5\sqrt{h/D_N}$, wherein $h$ is the height of each of the transverse ribs.

6. The steel bar as defined in claim 1 wherein the width ($w$) of said transverse ribs at the root is from $0.081D_N$ to $0.30D_N$ in which $D_N$ is a nominal diameter of the steel bar.

7. The steel bar as defined in claim 1 wherein the width ($w$) of said transverse ribs at the root is preferably from $0.17D_N$ to $0.30D_N$ in which $D_N$ is a nominal diameter of the steel bar.

8. The steel bar as defined in claim 1 wherein a flank angle defined by the thread surface of said transverse ribs and the top portion thereof is from 23° to 60°.

9. The steel bar as defined in claim 1 wherein the width of said longitudinal ribs is from L/36 to L/12 in which L is a nominal perimeter of the steel bar.

* * * * *

UNITED STATES PATENT AND TRADEMARK OFFICE

CERTIFICATE OF CORRECTION

PATENT NO. : 4,056,911

DATED : NOVEMBER 8, 1977

INVENTOR(S) : YOSHIO TANI

It is certified that error appears in the above-identified patent and that said Letters Patent are hereby corrected as shown below:

Column 2, line 16, change "Figures" to --Figure--.

Column 3, line 30, change "couling" to --coupling--.

Column 6, line 33, change "rollreduced" to --roll-reduced--.

Column 6, line 48, change "and" to --to--.

Column 6, line 53, change "virture" to --virtue--.

Column 7, line 47, change "commerically" to --commercially--.

Column 8, line 8, change "slipin" to --slip-in--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*